US006737797B2

(12) United States Patent
Keller

(10) Patent No.: US 6,737,797 B2
(45) Date of Patent: May 18, 2004

(54) KNEE ACTION CIRCUIT CONNECTOR FOR A CRT

(75) Inventor: Raymond Edward Keller, Clarks Summit, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 0 days.

(21) Appl. No.: 10/102,399

(22) Filed: Mar. 20, 2002

(65) Prior Publication Data

US 2003/0178932 A1 Sep. 25, 2003

(51) Int. Cl.[7] ..... H01J 29/88

(52) U.S. Cl. ..... 313/479; 313/482; 313/402; 313/407

(58) Field of Search ..... 313/402, 407, 313/479, 482

(56) References Cited

U.S. PATENT DOCUMENTS 4,310,779 A * 1/1982 Penird et al. ..... 313/407
4,571,521 A * 2/1986 Gallaro et al. ..... 313/402
4,670,686 A 6/1987 Muenkel et al. ..... 313/402
RE33,253 E * 7/1990 Strauss ..... 313/402
5,013,275 A * 5/1991 Kautz ..... 445/30
5,510,669 A * 4/1996 Van Buren ..... 313/402
6,188,171 B1 * 2/2001 Hamm ..... 313/407
6,448,702 B1 * 9/2002 Kamada et al. ..... 313/402

* cited by examiner

*Primary Examiner*—Vip Patel
*Assistant Examiner*—Holly Harper
(74) *Attorney, Agent, or Firm*—Joseph S. Tripoli; Carlos M. Herrera; Patricia A. Verlangieri

(57) ABSTRACT

The invention relates to a cathode-ray tube having funnel sealed at one end to a faceplate panel with a viewing screen on an interior surface thereof, the funnel and the faceplate panel form an evacuated envelope, and a mask frame assembly supported within the envelope and in proximity to the screen. The cathode-ray tube includes a knee action circuit connector which electrically connects the internal conductive coating which is supported on an inside surface of the funnel. The knee action circuit connector is disposed between the exterior surface of the magnetic shield and the inside surface of the funnel and extends from the magnetic shield to form a curved first contact portion resiliently engaging the conductive coating of the funnel and a second contact portion extending from the curved portion and urged inwardly against the exterior surface of the internal magnetic shield thereby making electrical contact between the conductive coating and the internal magnetic shield.

6 Claims, 3 Drawing Sheets

KNEE ACTION CIRCUIT CONNECTOR FOR A CRT

FIELD OF THE INVENTION

This invention pertains to a knee action circuit connector attached to an internal magnetic shield within a cathode-ray tube.

BACKGROUND OF THE INVENTION

A color cathode-ray tube (CRT) typically has an internal magnetic shield (IMS) to reduce the influence of magnetic fields on electron beam trajectories as a cathodoluminescent screen of the tube is scanned. The IMS is usually made of 0.1 mm thick cold-rolled steel and is fastened to a shadow-mask support frame so that the IMS and frame are magnetically coupled. The IMS is designed to fit into the funnel and be as close to the funnel wall as possible, but should not touch the funnel to avoid any friction between the IMS and a conductive anode coating on the inner surface of the glass funnel.

It has been conventional practice to attach a flexible contact spring to the rear portion of the IMS for effecting an electrical connection between the shield and the conductive coating on the inner surface of the funnel. One example of such a contact spring is shown in U.S. Pat. No. 4,670,686. This patent shows a contact spring attached to a rear portion of the IMS and extending forward toward the screen to a free end which contacts a conductive anode coating on the inner surface of the glass funnel. The IMS and contact spring assembly are loaded into the funnel from the front before application of the faceplate panel over a frit seal surface located at the front of the funnel As the IMS and contact spring assembly are loaded, the contact spring tends to engage the frit seal surface of the funnel and drag across both the frit seal surface and the conductive anode coating inside the funnel. This can cause frit particles to be introduced into the CRT as a contaminant which may later block apertures in the shadow mask through which electron beams pass from the electron gun to the screen or cause other detrimental effects.

SUMMARY OF THE INVENTION

The invention provides a cathode-ray tube (CRT) having a funnel sealed at one end to a faceplate panel with a viewing screen on an interior surface thereof wherein the funnel includes an internal conductive coating electrically connected to an anode button on the funnel. A mask frame support assembly is secured in proximity to the screen and includes an internal magnetic shield having an exterior surface extending along at least a portion of the inside surface of the funnel. A knee action circuit connector is disposed between the exterior surface of the magnetic shield and the inside surface of the funnel and extends from the magnetic shield to form a curved first contact portion resiliently engaging the conductive coating of the funnel and a second contact portion extending from the curved portion and urged inwardly against the exterior surface of the internal magnetic shield thereby making electrical contact between the conductive coating and the internal magnetic shield to complete an electrical circuit between the anode button and the IMS.

BRIEF DESCRIPTION OF THE DRAWINGS

The invention will now be described by way of example with reference to the accompanying figures of which.

DETAILED DESCRIPTION OF THE INVENTION

Figure 1:
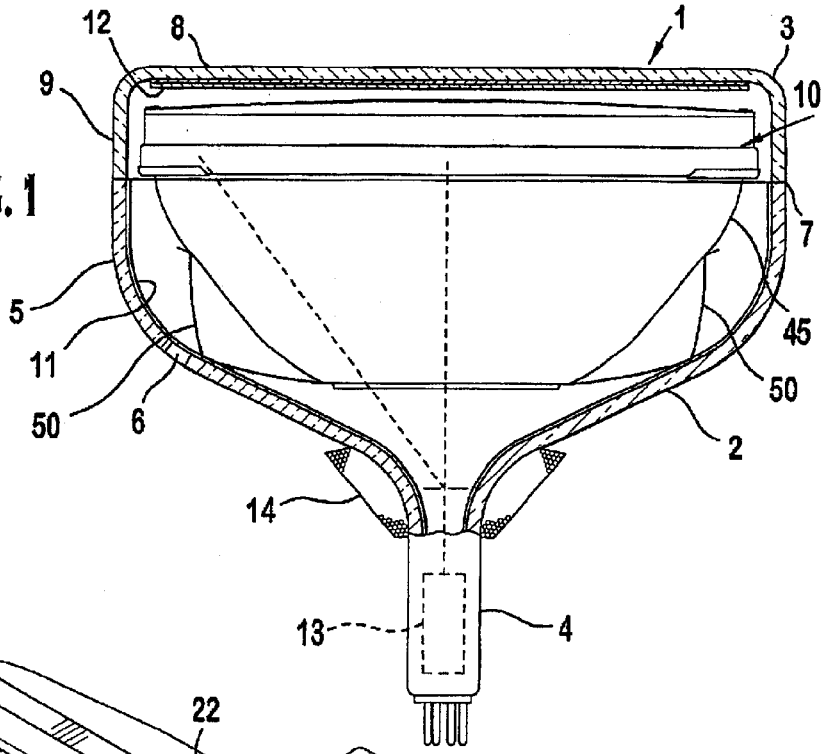
FIG. 1 is a cross sectional view of a cathode ray tube containing the knee action circuit connector of the present invention.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating 11 that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A mask support frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the mask support frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

An internal magnetic shield (IMS) 45 extends rearward from the mask support frame assembly 10 toward the electron gun 13. The IMS 45 is open both to the electron gun 13 at the rear end and open to the screen 12 at the front end. The IMS 45 is formed of a conductive material and serves to reduce the influence of magnetic fields on electron beam trajectories which impinge the screen 12 from the electron gun 13.

Figure 2:
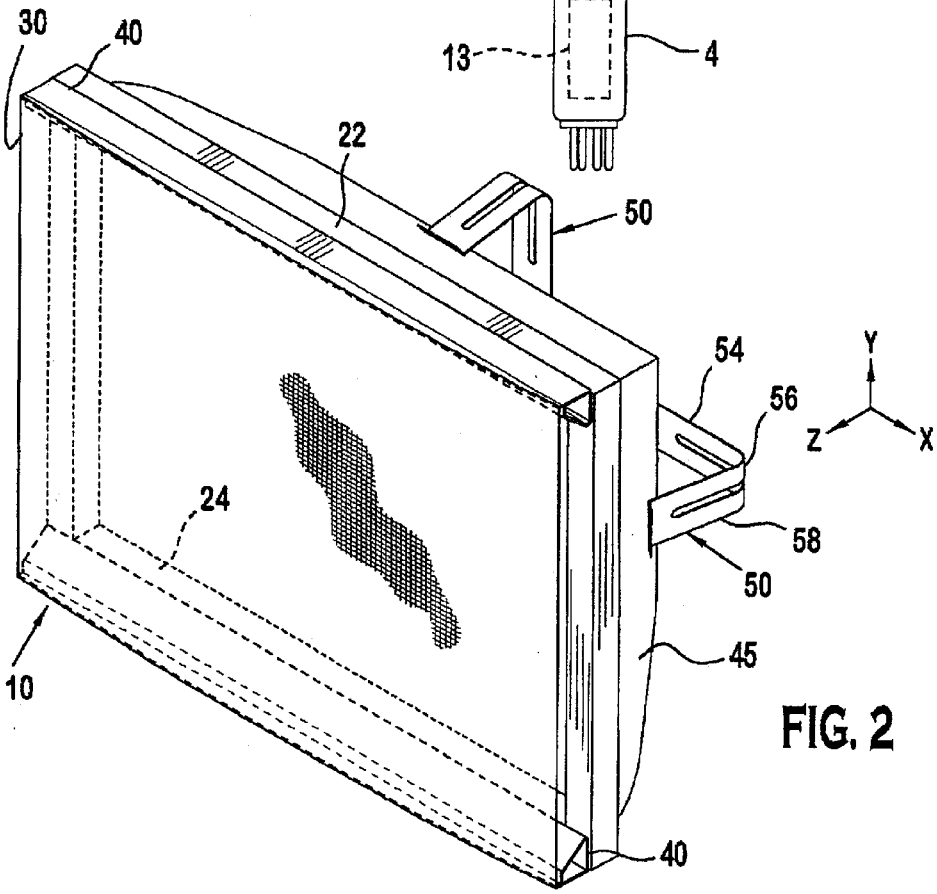
FIG. 2 is a perspective view of the cathode ray tube of FIG. 1.

A completed CRT 1 of FIG. 1, includes a mask support frame assembly 10 which is supported in the faceplate panel 3. The knee action circuit connector 50 is attached to the IMS 45 as will be described in further detail below. The support frame assembly 10 is illustrated in FIG. 2 as a tension mask system having a pair of opposed support blade members 40 which make up long side 22, 24 of the support frame assembly 10. A mask 30, having a plurality of apertures, is attached to the support blade members 40 and held in tension by the support frame assembly 10. Although the mask 30 is shown in FIG. 2 as a flat tension mask, it should be appreciated by those skilled in the art that the knee action circuit connector 50 can also be used in CRTs with other types of mask such as, formed shadow masks.

Figure 3:
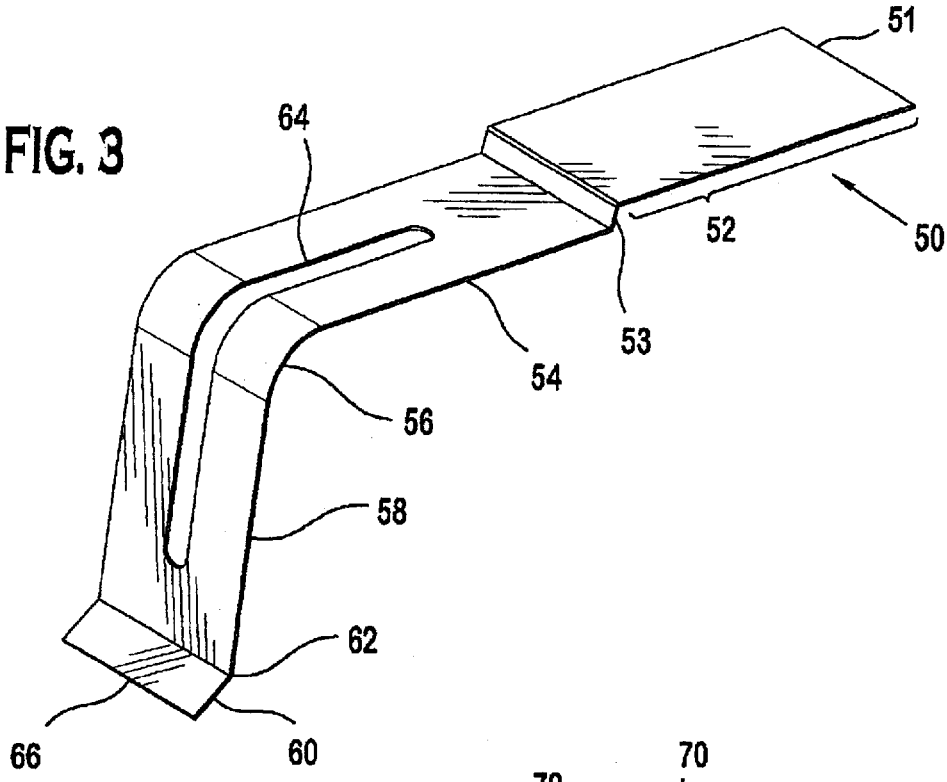
FIG. 3 is a perspective view of a knee action circuit connector according to the present invention.
Figure 5:
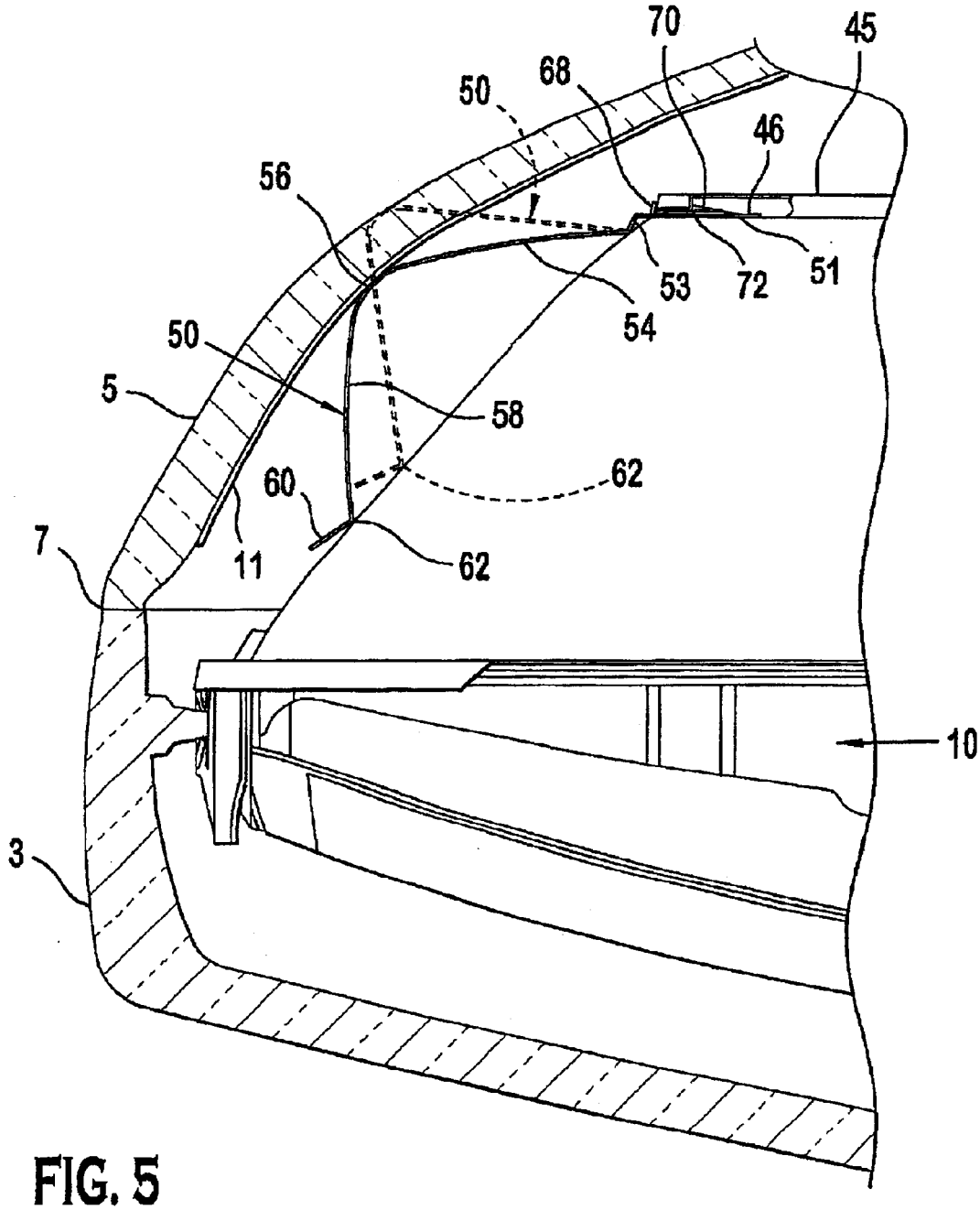
FIG. 5 is a partial exploded cross sectional view showing the knee action circuit connector both before and after insertion into the CRT.

Referring to FIG. 3, a first embodiment of the knee action circuit connector 50 is shown which includes a first leg 54 having an attachment end 51 for securing the connector 50 to the IMS. The knee action circuit connector 50 may be formed from any suitable flat-sided spring conductive material. The circuit connector 50 is bent back towards itself to form the first leg 54 and a second leg 58 which are integrally joined together by an intermediate curved first contact portion 56. First leg 54 terminates at the attachment end 51, and second leg 58 terminates in the contact-engagement free end 66. First leg 54 is somewhat longer than second leg 58 to extend beyond the offset portion or transition shoulder 53 so as to form a flat tongue 52. Transition shoulder 53 interconnects and provides an offsetting transition between the straight spring first leg 54 and the contact-engaging flat tongue 52. Tongue 52 may be secured near the rear end of the IMS such as by frictional insertion into a slot 46 as illustrated in FIG. 5.

Figure 4:
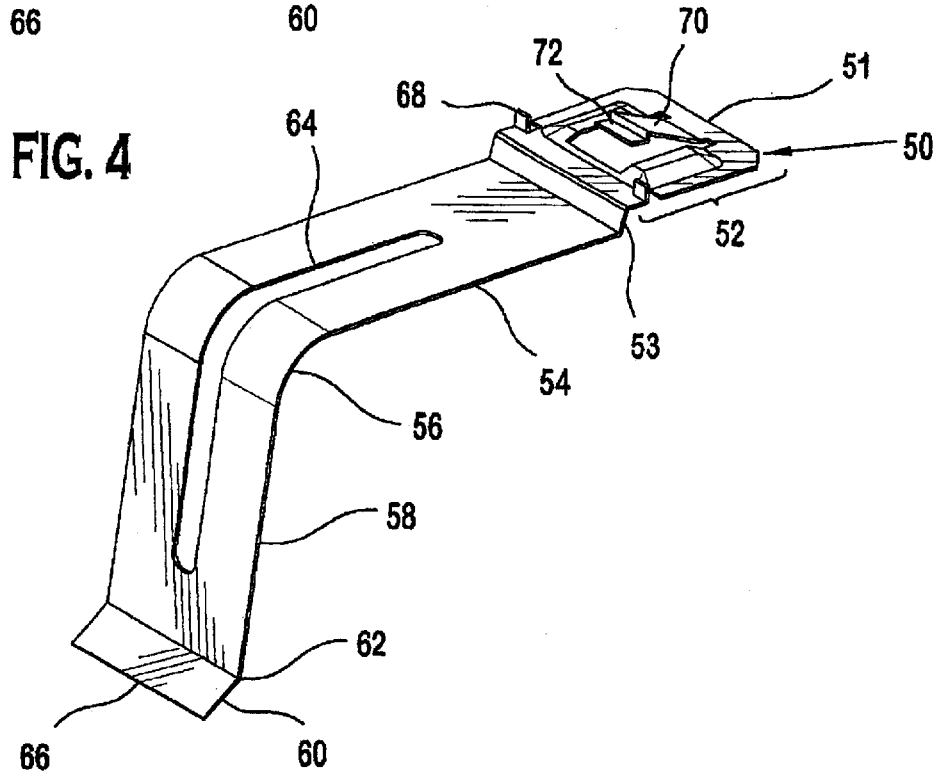
FIG. 4 is a perspective view of another embodiment of the knee action circuit connector according to the present invention.

Still referring to FIG. 3, knee action circuit connector 50 includes the second leg 58 between the intermediate curved first contact portion 56 and a free end 66. Free end 66 includes a bent, crooked or offset transition second contact portion 62 between the second leg 58 and angled portion 60. Each of the legs 54, 58 and curved first contact portion 56 is preferably bifurcated by the slot 64 to provide two coextensive independently deflectable leg portions as shown in FIGS. 3 and 4. It should be understood to one skilled in the art that other embodiment of the invention may also include variations on the location of the slot 64 wherein a specific portion of the connector is bifurcated or wherein the legs 54, 58 and first contact portion 56 are not bifurcated.

Another embodiment of the invention is shown in FIG. 4 having the same construction as that just described above. Accordingly, like reference numerals have been applied to designate like portions of connector 50. In addition to the portions described above, the second embodiment of connector 50 illustrated in FIG. 4 is provided with an attachment end 51. Attachment end 51 includes a latching mechanism 70 having an angled element 72. The latching mechanism slides into the slot 46 of the IMS 45 (shown in FIG. 5) such that the angled element 72 prevents the attachment end 51 from sliding out of the slot 46. The attachment end 51 can further include stops 68 which restrict the extent to which the attachment end 51 can slide into the slot 46.

Assembly of the knee action circuit connector 50 to the IMS 45 and insertion into the funnel 5 will now be described in greater detail with reference to FIGS. 3–5. First, the tongue 52 is inserted into a slot 46 to secure it to the IMS 45. In the case of the embodiment shown in FIG. 4, the knee action circuit connector 50 can be secured to the IMS 45 by various means such as, crimping or bending the tongue 52 or by friction between the slot 46 and the tongue 52. The knee action circuit connector 50 is positioned such that the second contact portion 62 is in electrical contact with an exterior surface of the IMS at a location remote from the slot 46 as indicated by the phantom lines in FIG. 5. With the mask support frame assembly secured within the CRT, the first contact portion 56 of the connector 50 seats against the conductive coating 11 of the funnel 5 to flex or deflect each leg 54, 58 inwardly toward the IMS 45, whereby the first contact portion 56 and second contact portion 62 of the connector 50 is yieldably biased into contact with the coating 11 and IMS 45 respectively as shown by the solid lines in FIG. 5.

As shown in FIG. 5, the knee action circuit connector 50 establishes contact or engagement between the IMS 45 and the conductive coating 11. One of these contacts is the seating contact of the first contact portion 56 on the conductive coating 11 and the other point of engagement is the second contact portion 62 with the IMS 45. Between these two points of engagement the knee action circuit connector 50 is free to flex or bow in either direction that is, either towards the IMS 45 or away from the IMS 45. The distance between the inside surface of the funnel 5 and the exterior surface of the IMS 45 is smaller than the corresponding projected dimension between the opposite ends of each leg 54, 58 in its relaxed, unflexed condition. Because of this arrangement and because of the connector engagement described above, the knee action circuit connector 50 lying between the funnel and IMS will be urged against the coating to force the connector to flex or bow inwardly towards the IMS 45. The knee action circuit connector 50, once resiliently engaged, serves to complete an electrical circuit from the IMS 45, through the internal conductive coating 11, to the anode button 6. This engagement eliminates the possibility of free ends of a the conventional contact springs from bouncing against the conductive coating and thereby generating loose particles within the complete CRT 1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A cathode-ray tube having a funnel sealed at one end to a faceplate panel with a viewing screen on an interior surface thereof, the funnel and the faceplate panel form an evacuated envelope, a mask frame assembly supported within the envelope and in proximity to the screen, comprising:

an internal conductive coating supported on an inside surface of the funnel, the funnel having an anode button in electrical contact with the internal conductive coating;

an internal magnetic shield secured to the mask frame assembly; the internal magnetic shield having an exterior surface extending along at least a portion of the inside surface of the funnel and being spaced therefrom; and, a knee action circuit connector disposed between the exterior surface of the magnetic shield and the inside surface of the funnel, wherein the knee action circuit connector has two legs joined to each other by a curved first contact portion, each leg having an end being in contact with the exterior surface of the internal magnetic shield and opposite the curved first contact portion the curved first contact portion resiliently engaging the internal conductive coating.

2. The cathode-ray tube as in claim 1 further comprising a tongue located at an end of one of the legs, the tongue fitting into a slot of the internal magnetic shield.

3. The cathode-ray tube as in claim 1 wherein the knee action circuit connector comprises an attachment end at an end of one of the legs, said attachment end having a latching mechanism which is raised out of said attachment nd and angled thereto, said attachment end fits into a slot of the internal magnetic shield such that said latching mechanism is positioned within said slot thereby preventing said attachment end from sliding out of said slot.

4. A cathode ray tube comprising:

a vacuum envelope having a neck, a funnel comprising an internal electrically conductive costing, a faceplate with an inside surface, and a skirt extending between the faceplate and the funnel;

a mask support frame assembly to which an internal magnetic shield is secured, the mask support frame assembly being secured within the vacuum envelope near the inside surface of the faceplate; and, a knee action circuit connector extending from the internal magnetic shield and forming a curved first contact portion in contact with the internal conductive coating of the funnel and a second contact portion extending from the curved portion and in contact with the external surface of the internal magnetic shield, whereby an electrical connection is formed between the funnel coating and the internal magnetic shield.

5. The internal magnetic shield as in claim 4 wherein the knee circuit connector is formed of a spring conductive material for exerting a biasing force to resiliently bias the curved first contact portion outwardly to engage the inner conductive coating and to urge against the coating to force the knee action circuit connector inwardly to cause the second contact portion to make electrical contact with the internal magnetic shield.

6. The internal magnetic shield as in claim 4 further comprises a slot extending along the length of the knee action circuit connector for bifurcating a portion to the connector.

* * * * *